US006909079B2

(12) United States Patent
Lee et al.

(10) Patent No.: US 6,909,079 B2
(45) Date of Patent: Jun. 21, 2005

(54) MICROWAVE OVEN HAVING AN INTERNAL COMPONENTS COOLING STRUCTURE

(75) Inventors: Dong Heon Lee, Changwon-si (KR); Sang Ryul Lee, Masan-si (KR); Yang Kyeong Kim, Bucheon-si (KR); Wan Soo Kim, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/713,271

(22) Filed: Nov. 17, 2003

(65) Prior Publication Data

US 2004/0094541 A1 May 20, 2004

(30) Foreign Application Priority Data

Nov. 20, 2002 (KR) ..... 10-2002-0072423

(51) Int. Cl.[7] ..... H05B 6/64
(52) U.S. Cl. ..... 219/757; 210/761; 126/21 A
(58) Field of Search ..... 219/757, 756, 219/761, 760; 126/21 A

(56) References Cited

U.S. PATENT DOCUMENTS 3,654,417 A 4/1972 Javes et al.
4,184,945 A * 1/1980 Morgan et al. ..... 219/757
4,786,774 A 11/1988 Kaminaka
4,812,617 A 3/1989 Takeuji et al.
5,814,793 A * 9/1998 Yu ..... 219/757
5,945,023 A * 8/1999 Yang ..... 219/756
6,320,171 B1 11/2001 Kim

FOREIGN PATENT DOCUMENTS

GB 2 239 379 A 6/1991
JP 63-127026 * 5/1988

* cited by examiner

*Primary Examiner*—Philip H. Leung
(74) *Attorney, Agent, or Firm*—Fleshner & Kim LLP

(57) ABSTRACT

Microwave oven including an outer case forming a top and sides of a cabinet, a base plate forming a bottom of the cabinet, a front panel and a rear panel mounted in a front part and a rear part of the base plate for forming a front surface and a rear surface respectively, an inner case forming a cooking chamber on the base plate, first and second transformer mounted at corners of one side of the base plate, a fan above the second transformer for drawing external air, a fan motor connected to the fan for providing a driving power to the fan, a fan housing for protecting the fan, an air duct between the first and second transformers, having one end in communication with the fan housing and the other end branched to first and second branch ducts, and first and second magnetron on an outside surface of the inner case, the first and second magnetron connected to the first and second branch ducts respectively, thereby cooling various components of the microwave oven, smoothly.

31 Claims, 10 Drawing Sheets

MICROWAVE OVEN HAVING AN INTERNAL COMPONENTS COOLING STRUCTURE

This application claims the benefit of the Korean Application No. P2002-0072423 filed on Nov. 20, 2002, which is hereby incorporated by reference.

BACKGROUND OF THE INVENTION

1. Field of the Invention

The present invention relates to microwave ovens, and more particularly, to a structure of a microwave oven, which can cool down various components of the microwave oven, smoothly.

2. Background of the Related Art

In general, the microwave oven (MWO) cooks food with heat from friction between molecules caused by disturbance of the molecular arrangement of the food made with a microwave (approx. 2,450 MHz). The microwave oven may have one or more than one magnetrons.

The microwave oven with one magnetron is used as domestic use where the microwave oven is not used frequently, and the microwave oven with more than one magnetrons is used as commercial use for convenience store and the like where the magnetron is used frequently.

FIGS. 1~5 illustrate inside structures of related art microwave ovens each with two magnetrons schematically, referring to which the microwave oven will be described.

Referring to FIG. 1, the related art commercial microwave oven is provided with an outer case 11, a base plate 12, an inner case 13 of a cooking chamber, a front panel 14, a rear panel 15, and an outfit room.

The front panel 14 is mounted in a front part of the base plate 12, and, as shown in FIG. 2, the base plate 12 has a plurality of inflow holes 12*a* for drawing external air.

The inner case 13 has a plurality of outflow holes 13*a*. The rear panel 15 is mounted in a rear part of the base plate 12, and, as shown in FIG. 3, has discharging holes 15*a* and 15*b* for discharging air.

Referring to FIGS. 4 and 5, in the outfit room, there are one pair of transformers 16*a*, and 16*b*, one pair of magnetrons 17*a*, and 17*b*, a fan 18*a*, and a fan motor 18*b* provided thereto.

The one pair of transformers 16*a* and 16*b* are mounted on the base plate 12 side by side. The one pair of the magnetron 17*a* and 17*b* are mounted in an upper part and a lower part of the inner case 13, respectively. A microwave from the magnetrons 17*a* and 17*b* propagates to an upper space and a lower space of the inner case 13 through guide ducts (not shown).

The fan 18*a* is mounted in a space between the transformers 16*a* and 16*b*, and the magnetrons 17*a* and 17*b* in the outer case 11, and connected to the fan motor 182*b* in a state protected with a fan housing 18*c*.

The fan housing 18*c* has a suction side facing a lower space. The fan housing 18*c* is in communication with an air duct 19 for guiding air flow to the magnetrons 17*a* and 17*b*. An end of the air duct 19 is in communication with the discharging holes 15*a* and 15*b* in the rear panel 15.

A process for cooling the components of the microwave oven will be described in detail.

When the microwave oven is put into operation, the fan 18*a* rotates as the fan motor 18*b* is driven, to draw external air. The external air is introduced into the microwave oven through the inflow holes 12*a* in the base plate 12, and cools the one pair of transformers 16*a* and 16*b* as the external air moves toward the fan 18*a*. Then, the external air cools the magnetrons 17*a* and 17*b* through the air duct 19 in communication with the fan housing 18*c*.

In this instance, a portion of the air passed through the magnetrons 17*a* and 17*b* is discharged through the discharging holes 15*a* in the upper part of the rear panel 15 via the outflow holes 13*a*. Rest of the air passed through the magnetrons 17*a* and 17*b* is discharged through the discharging hole 15*b* in a lower part of the rear panel 15.

However, the related art microwave oven has the following problems.

First, the one pair of magnetrons in the related art microwave oven, mounted in a rear space of the magnetron, can not but increase the rear space of the microwave oven. Therefore, the inner case becomes smaller in comparison of a total size of the microwave oven. Moreover, the increase size of the microwave oven to require a more installation space can not but limit an installation space.

Second, the position of the fan mounted in a corner of one side of the outer case impedes the external air introduced through the base plate to cool the front transformer, smoothly. That is, since the front transformer is mounted in a blind area of air flow, cooling of the transformer has not been smooth.

Third, the fan motor in the related art microwave oven generates much heat when driven. However, since the related art microwave oven is not provided with a separate structure for cooling the fan motor, overheat of the fan motor causes a poor performance.

SUMMARY OF THE INVENTION

Accordingly, the present invention is directed to a microwave oven that substantially obviates one or more of the problems due to limitations and disadvantages of the related art.

An object of the present invention is to provide a microwave oven in which cooling of various components are smooth.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the microwave oven includes an outer case forming a top and sides of a cabinet, a base plate forming a bottom of the cabinet, a front panel and a rear panel mounted in a front part and a rear part of the base plate for forming a front surface and a rear surface respectively, an inner case forming a cooking chamber on the base plate, first and second transformer mounted at corners of one side of the base plate, a fan above the second transformer for drawing external air, a fan motor connected to the fan for providing a driving power to the fan, a fan housing for protecting the fan, an air duct between the first and second transformers, having one end in communication with the fan housing and the other end branched to first and second branch ducts, and first and second magnetrons on an outside surface of the inner case, the first and second magnetrons connected to the first and second branch ducts, respectively.

The base plate includes a front part having a plurality of inflow holes, and the inner case includes a plurality of inlet holes for introduction of the air passed through the first and second branch ducts and the first and second magnetrons, and a plurality of outlet holes for discharging the air introduced into the inner case through the inlet holes.

The outlet holes are connected to a plurality of discharging ducts for guiding flow of air discharged from the inner case. The rear panel has a plurality of first outlet holes connected to the discharging ducts for discharging air to an outside of the cabinet.

The base plate is provided with a guide for uniform supply of external air introduced thereto through the inflow holes to the first and second transformers. The guide has a form of a square bar with one positioned between the inflow holes, and the other end positioned between the first and second transformers.

The rear panel has a third outflow holes for discharging the air passed through the second transformer, and the air duct is mounted spaced a distance apart from an inside wall of the outer case. The first and second branch ducts of the air duct include sloped duct walls respectively such that each of the ducts becomes the narrower as it goes closer to a part connected to the first or second magnetron.

The first branch duct is connected to a first duct for guiding air flow toward the fan motor, and the first magnetron is connected to the first duct. The rear panel has a second outflow hole for discharging the air cooled the fan motor through the first duct to an outside of the cabinet.

The air duct includes a split guide between the first and second branch ducts for guiding the air introduced thereto through the fan. The split guide is formed by bending an inside wall of the air duct.

In a second embodiment of the present invention, the first branch duct is connected to a second duct for guiding flow of air to the rear panel, and the first magnetron is mounted in the second duct. The rear panel includes a second outflow hole connected to the second duct for discharging the air introduced thereto to an outside of the cabinet.

The second duct includes a first communication hole formed therein for supplying air for cooling the fan motor.

In a third embodiment of the present invention, the second branch duct is connected to a third duct for guiding flow of air to the rear panel, and the second magnetron is in the third duct.

The rear panel includes a third outflow hole for discharging the air introduced thereto to an outside of the cabinet, and the third duct includes a second communication hole for guiding air flow to the fan motor.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

Figure 1:
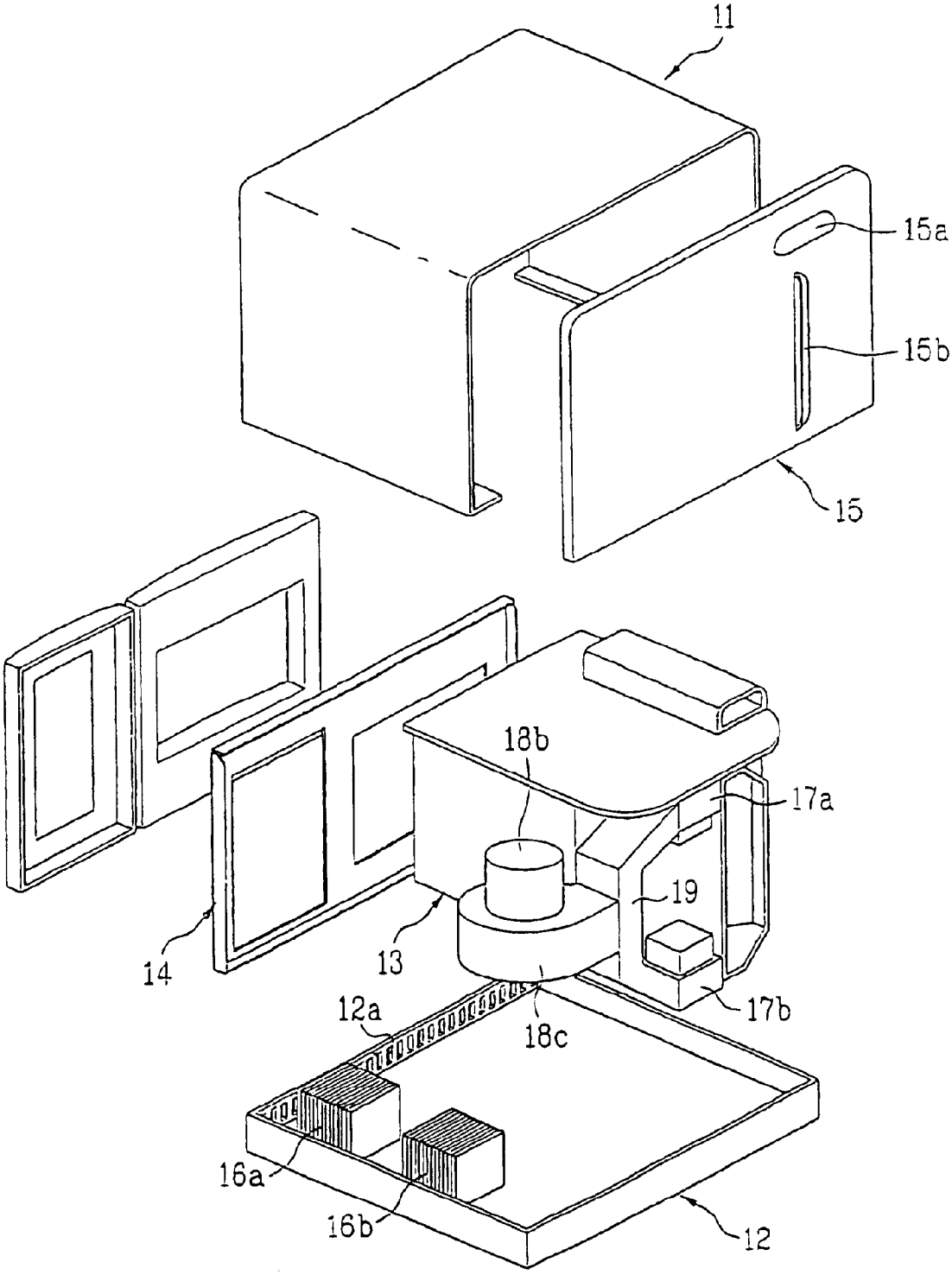
FIG.1 (Related Art)
FIG. 1 illustrates a disassembled perspective view of a related art microwave oven, schematically.
Figure 2:
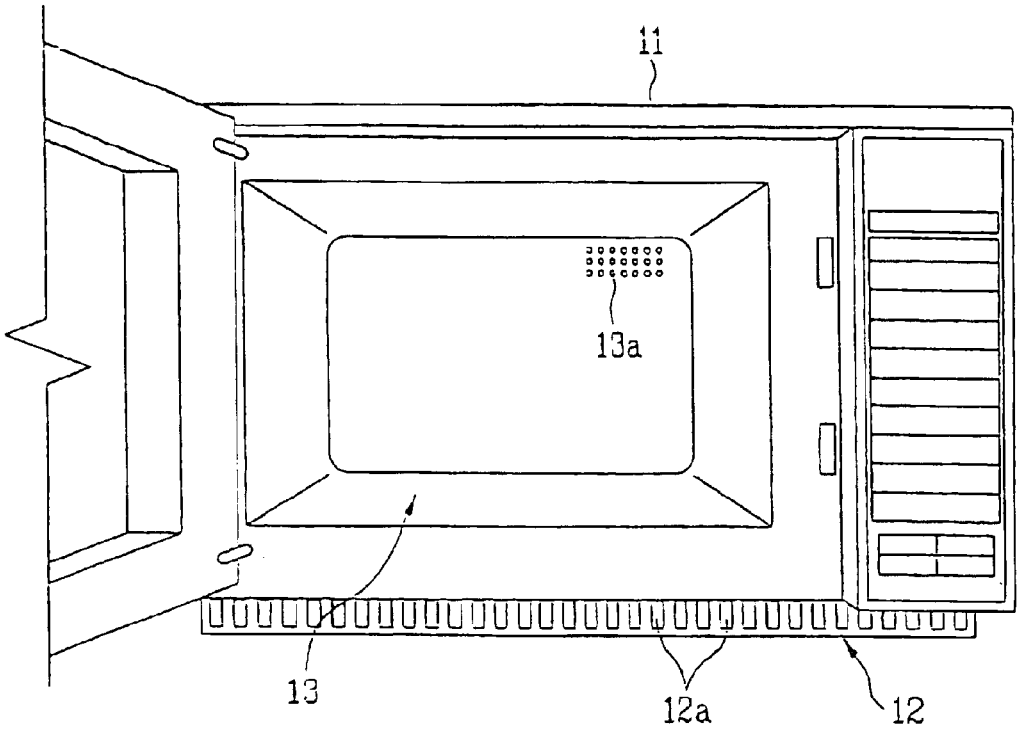
FIG. 2 (Related Art)
FIG. 2 illustrates an inner case of a related art microwave oven.
Figure 3:
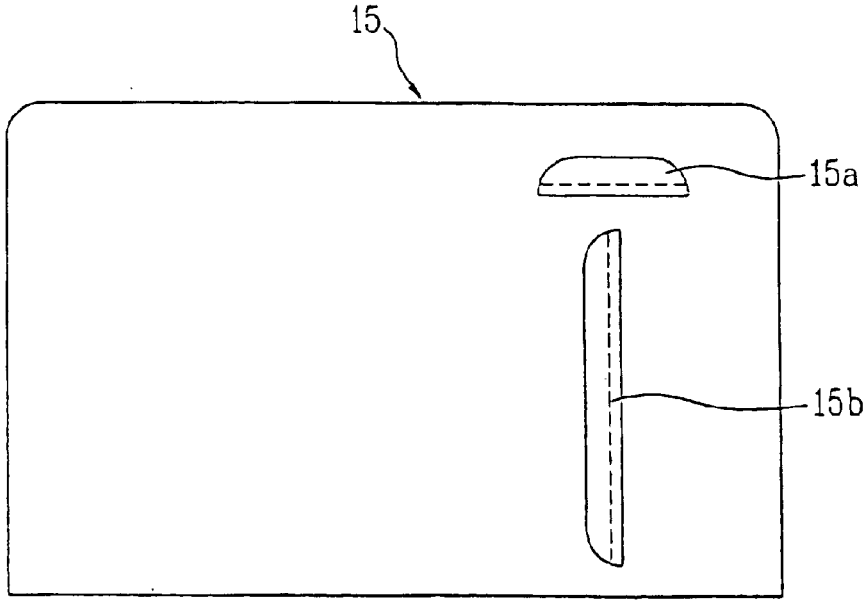
FIG. 3 (Related Art)
FIG. 3 illustrates a rear panel of a related art microwave oven.
Figure 4:
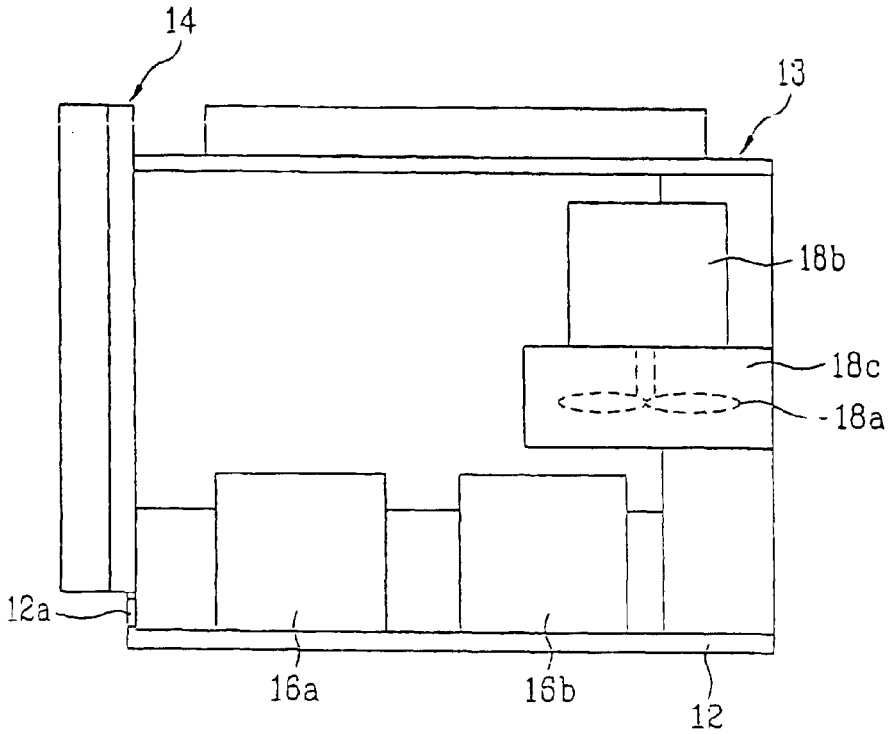
FIG. 4 (Related Art)
FIG. 4 illustrates a side view of an inside structure of a related art microwave oven.
Figure 5:
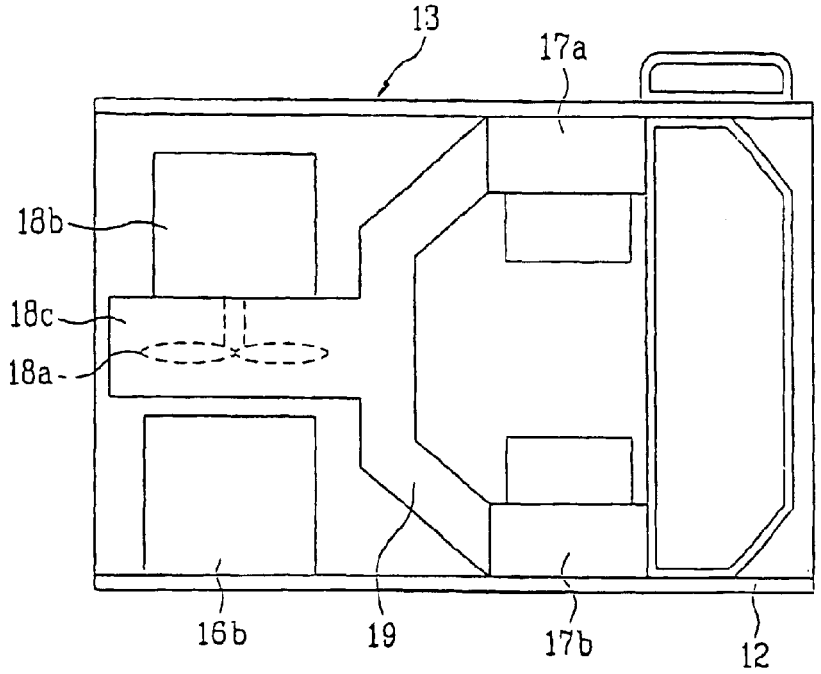
FIG. 5 (Related Art)
FIG. 5 illustrates a back view of an inside structure of a related art microwave oven.
Figure 6:
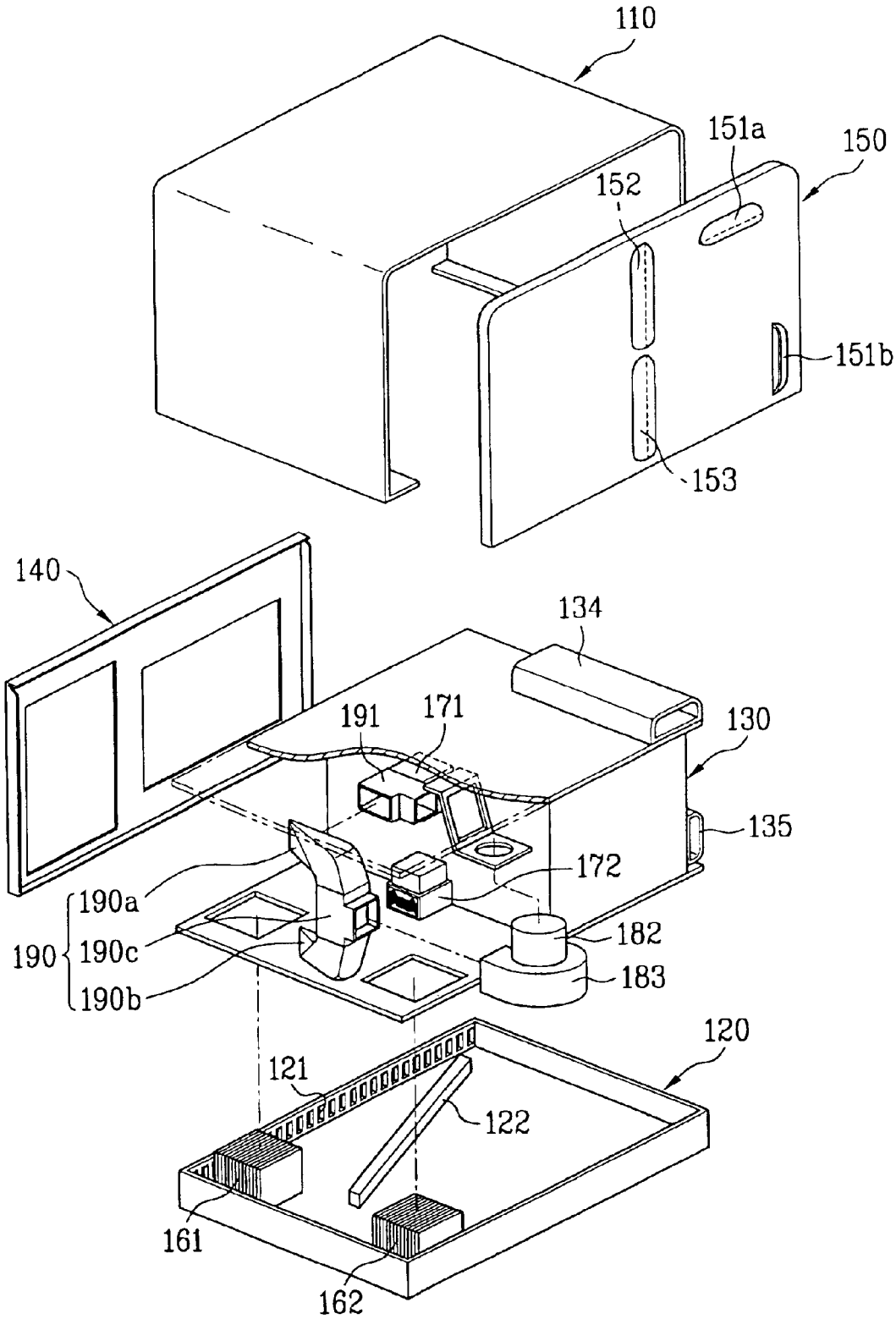
FIG. 6 illustrates a disassembled perspective view of a microwave oven in accordance with a first preferred embodiment of the present invention, schematically.

Referring to FIG. 6, the first embodiment microwave oven of the present invention includes an outer case 110, a base plate 120, a front panel 140, and a rear panel 150 to form a cabinet of the microwave oven.

The outer case 110 forms side surfaces and a top surface, and the base plate 120 forms a bottom of the cabinet. The front panel 140, and the rear panel 150 are mounted in a front part and the rear part of the base plate 120, to form a front face and a rear face of the cabinet.

There is an inner case 130 formed above the base plate 120. The inner case 130 is used as a cooking chamber, and has transformers, an air duct 190, and various electronic components, such as magnetrons, fitted at sides thereof.

Figure 9:
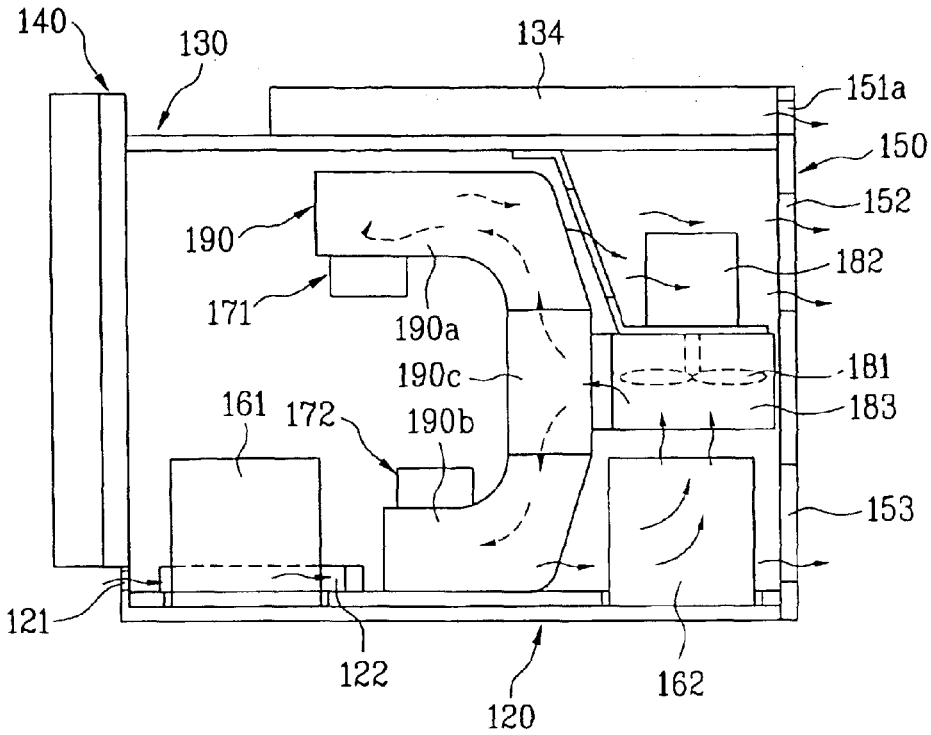
FIG. 9 illustrates a side view of an inside structure of a microwave oven of the present invention.

The transformer includes first and second transformers 161 and 162 mounted at corners of one side of the base plate 120. As shown in FIG. 9, there is a fan 181 above the second transformer 162 for drawing external air. The fan 181 is protected by the fan housing 183, and coupled with the fan motor 182.

The air duct 190 is fitted between the first and second transformers 161 and 162, and has one end in communication with the fan housing 183, and the other end branched into first and second branch ducts 190*a*, and 190*b*.

The magnetron is mounted on an outside surface of the inner case 130, and includes first and second magnetrons 171 and 172 connected to the branch ducts 190*a* and 190*b*. The first and second magnetrons 171 and 172 are cooled by the air introduced into the first and second branch ducts 190*a* and 190*b*.

The base plate 120 has a plurality of inflow holes 121 in a front surface thereof. The inflow holes 121 serves as ducts of external air introduced into the cabinet by the fan 181.

Figure 7:
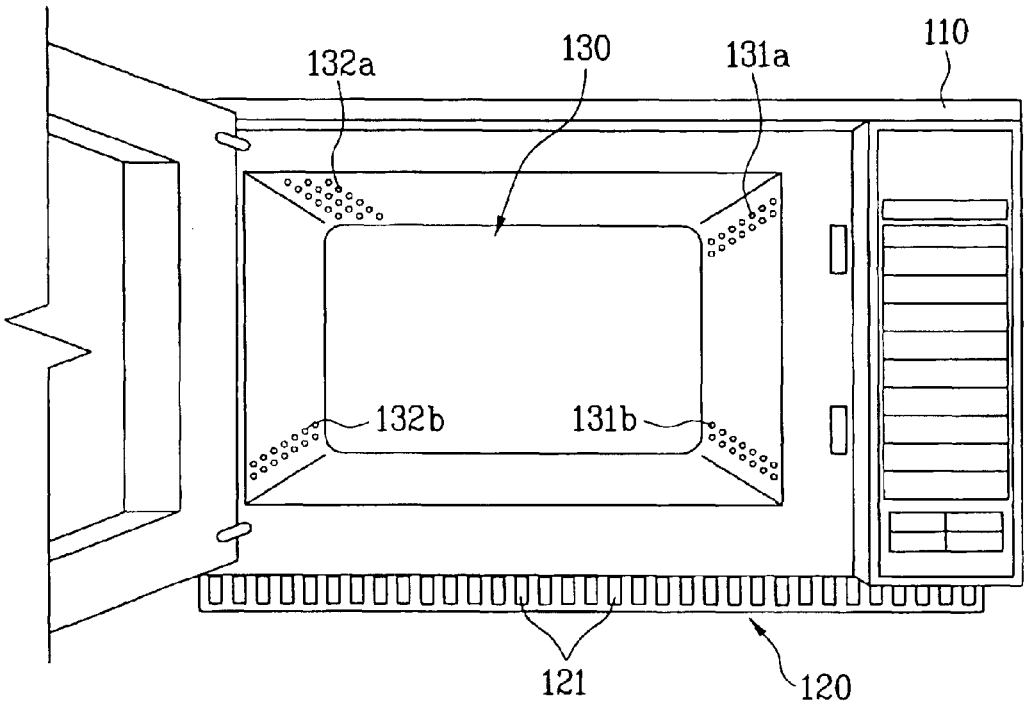
FIG. 7 illustrates front view of an inner case of a microwave oven of the present invention.

Referring to FIG. 7, the inner case 130 has a plurality of inlet holes 131*a* and 131*b* for introduction of the air having cooled the magnetrons 171 and 172. There are a plurality of outlet holes 132*a* and 132*b* in an upper surface or lower surface of an opposite side of the inlet holes 131*a* and 131*b*. The outlet holes 132*a* and 132*b* discharge the air introduced into the inner case 130 through the inlet holes 131*a* and 131*b*.

There are discharge air ducts 134 and 135 fitted to an outside surface of the inner case 130 having the outlet holes 132*a* and 132*b* formed therein. The discharge air ducts 134 and 135 guide air discharged through the outlet holes 132*a* and 132*b*, respectively.

There may be one or more than one discharge ducts 134 and 135, and the first embodiment of the present invention suggests the first and second discharge air ducts 134 and 135. The first discharge air duct 134 is connected to the outlet holes 132*a* on the top surface of the inner case 130, and the second discharge air duct 135 is connected to the outlet holes 132*a* in a bottom thereof.

Figure 8:
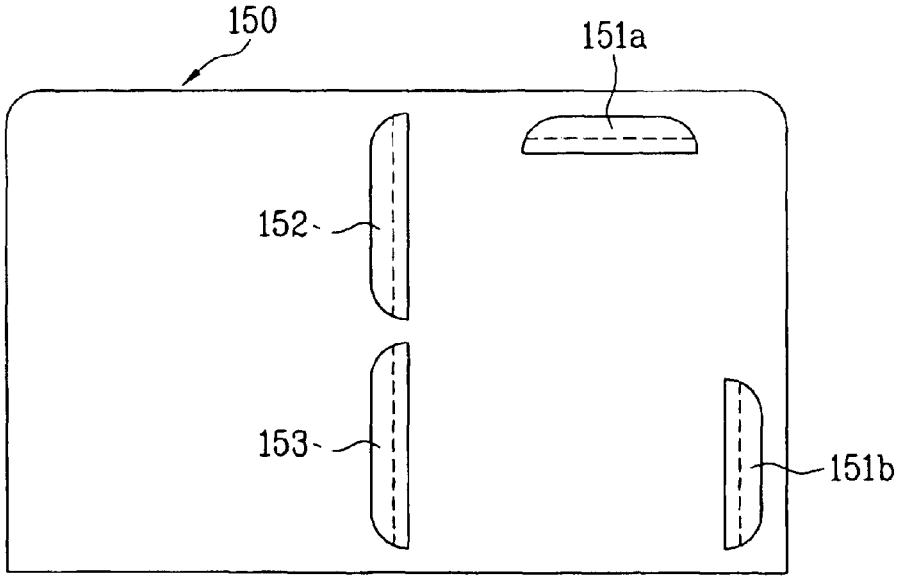
FIG. 8 illustrates a rear panel of a microwave oven of the present invention.

Referring to FIG. 8, the rear panel 150 has a plurality of first outflow holes 51*a* and 151*b*. The first outflow holes 151*a* and 151*b* are connected to the discharge air ducts 134 and 135 for discharging air to an outside of the cabinet, respectively. Therefore, positions of the first outflow holes 151*a* and 151*b* are dependent on end positions of the discharge air ducts, respectively. In the first embodiment of the present invention, the first outflow holes 151*a* and 151*b* are in an upper part and a lower part of one side part of he rear panel 150.

The rear panel 150 also has a third outflow hole 153 for discharging the air passed through the second transformer 162. The third outflow hole 153 discharges the portion of air that is not introduced into the air duct 190 of the air introduced through the inflow holes 121 and cooled the second transformer 162. According to this, air flow in the microwave oven becomes smooth, to increase a flow rate of inflow/outflow air, to improve a cooling efficiency of the transformers 161 and 162.

In the meantime, the base plate 120 has a guide 122 for supplying the external air introduced through the inflow holes 121 both to the first and second transformers 161 and 162 at the same time. The guide 122, in a form of a bar, is provided between the first and second transformers 161 and 162.

In more detail, the guide 122 has one end positioned between the inflow holes 121, and the other end positioned between the first, and second transformers 161 and 162. Accordingly, the external air is provided to the first and second transformers 161 and 162 at the same time by the guide 122, and cools the first and second transformers 161, and 162, uniformly.

Of course, there can be a variety of forms and fitting positions of the guide 122. For an example, the guide 122 may be formed such that the external air passes through the first and second transformers 161 and 162 in succession. However, uniform cooling of the transformers 161 and 162 is more favorable for improving performance of the transformers 161 and 162. Therefore, in the embodiments of the present invention, the guide 122 is formed such that an end of the guide 122 is directed a point substantially in the middle of the transformers 161 and 162.

In the meantime, the air duct 190 is spaced a distance from an inside wall of the outside case 110. Therefore, as there is a gap between the air duct 190 and the outside case 110, flow of an inside air becomes smooth.

The first and second branch ducts 190*a* and 190*b* of the air ducts 190 has a sloped duct walls such that the duct becomes the narrower as it goes closer to a part connected to the first and second magnetrons 161 and 162. This structure increases a flow speed of the air passing through the first and second branch ducts 190*a* and 190*b*, to enable smooth outflow and inflow of the air.

Figure 11:
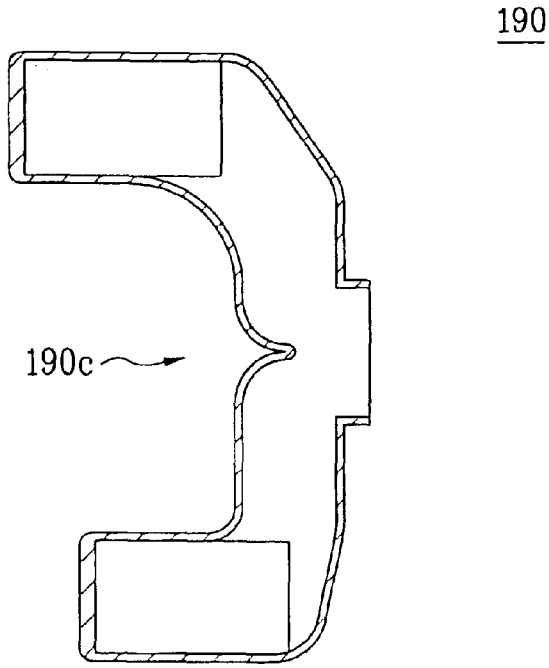
FIG. 11 illustrates an inside structure of an air duct in the microwave oven of the present invention in accordance with a preferred embodiment of the present invention.
Figure 12:
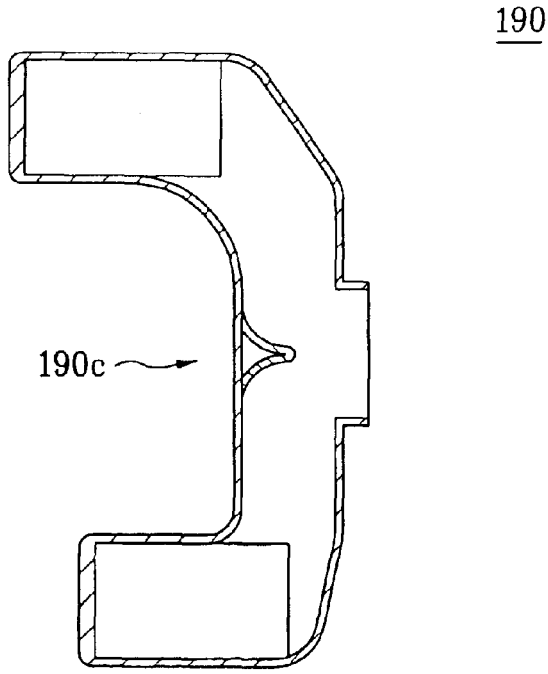
FIG. 12 illustrates an inside structure of an air duct in the microwave oven of the present invention in accordance with another preferred embodiment of the present invention.

Referring to FIG. 11, the air duct 190 has a split guide 190*c* formed between the first and second branch ducts 190*a* and 190*b*. The split guide 190*c* guides the air introduced thereto through the fan 181 to the first and second branch ducts 190*a* and 190*b*. The split guide 190*c* may be formed by bending an inside wall of the air duct 190, or as a separate unit projected from the inside wall of the air duct 190 as shown in FIG. 12.

The first branch duct 190*a* is connected to a first duct 191 for guiding air to the fan motor 182. The first magnetron 171 is connected to the first duct 191. Therefore, the air introduced into the first branch duct 190*a* cools the fan motor 182 and the first magnetron 171 following the first duct 191. It is preferable that the first duct 191 is formed as a unit with the air duct 190.

In the meantime, there can be a variety of variations of the first duct 191. That is, a part of the air duct 190 at a position of the fan motor 182 may be opened, for guiding a portion of the air from the air duct 190 to the fan motor 182, for cooling the fan motor 182.

Moreover, for discharging the air that cooled the fan motor 182 through the first duct 191, a second outflow hole 152 is formed in the rear panel 150, additionally.

Figure 10:
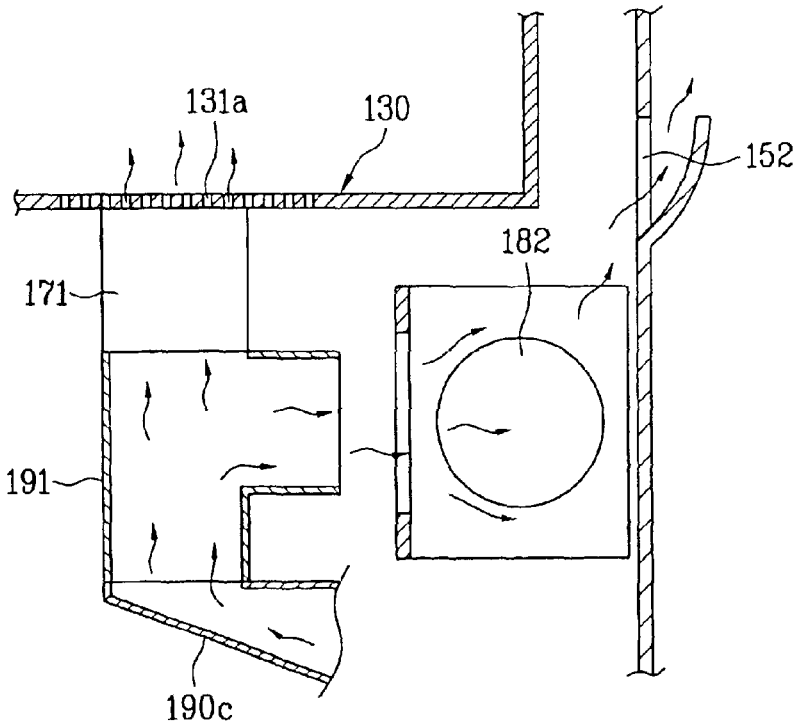
FIG. 10 illustrates a fitted state of a first duct of an air duct in the microwave oven of the present invention, schematically.

A process of air flow in the microwave oven will be described with reference to FIGS. 9 and 10.

Upon putting the microwave oven into operation, the fan 181 is driven by the fan motor 182 to draw external air. In the instance, the external air is introduced into the cabinet through the inflow holes 121 in the base plate 120.

Then, the external air is guided to the first transformer 161 and the second transformer 162 at the same time by the guide 122 on the base plate 120, to cool the transformers 161 and 162, respectively.

Most of the air that cooled the second transformer 162 is introduced into the air duct 190 through the fan 182, rest of the air is discharged to rear of the microwave oven through the third outflow hole 153 in the rear panel 150.

Most of the air that cooled the first transformer 161 flows identical to the air that cooled the second transformer 162. However, a portion of the air is introduced into spaces of the second outflow hole 152 and the third outflow hole 153 through a gap between the air duct 190 and the outside case 110 respectively, and discharged to an outside of the cabinet through the outflow holes 152 and 153.

The air flowing through the air duct 190 is split into the first and second branch ducts 190*a* and 190*b* by the split guide 190*c*. The air introduced into the first branch duct 190*a* moves along the first duct 191 and passes through the first magnetron 171. A portion of the air passed through the first magnetron 171 is introduced into the cooking chamber in the inner case 130 through the inlet holes 131*a*. Rest of the air moves along the first duct 191 to a space the fan motor 182 is positioned therein, and cools the fan motor 182. Then, the air that cooled the fan motor 182 is discharged to rear of the microwave oven through the second outflow holes 152 in the rear panel 150.

The air introduced into the second branch duct 190*b* is introduced into the inner case 130 through the inlet holes 131*b* via the second magnetron 172.

In the meantime, the air introduced into the cooking chamber circulates inside of the cooking chamber, and introduced into the first and second discharge ducts 134 and 135 through the outlet holes 132*a* and 132*b*, respectively. Then, the air moves along the discharge ducts 134 and 135, and discharged to rear of the microwave oven through the first outflow holes 151*a* and 151*b*.

Figure 13:
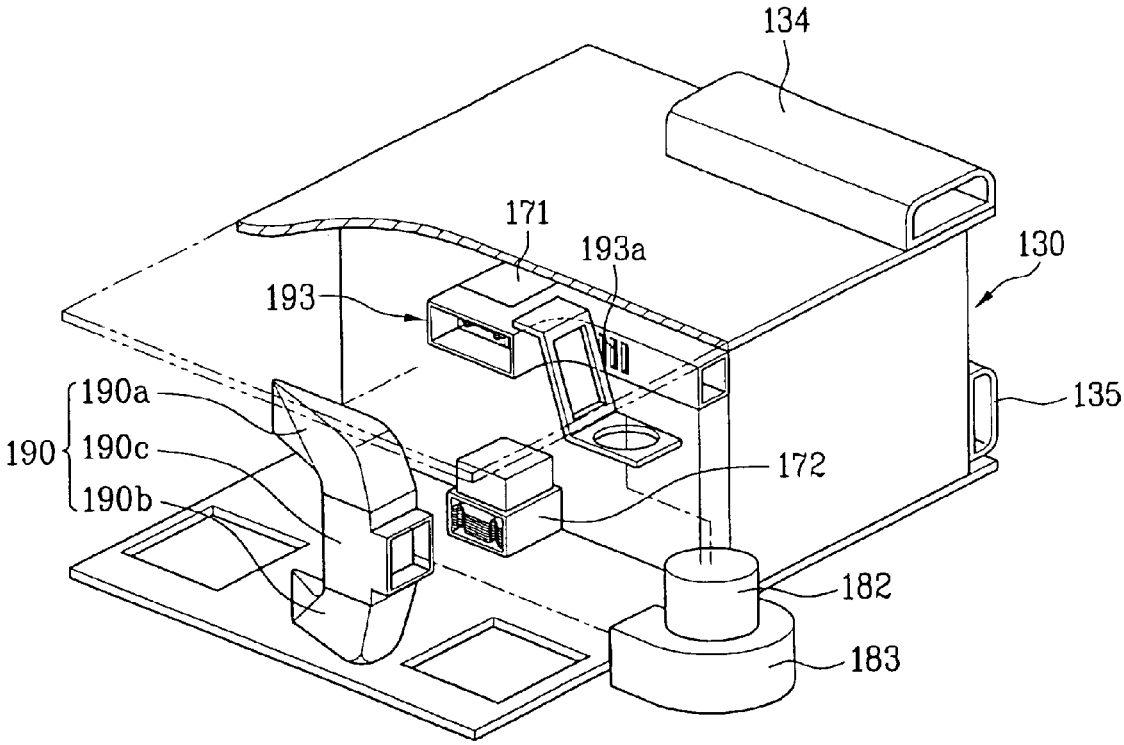
FIG. 13 illustrates a disassembled perspective view showing an inside structure of a microwave oven in accordance with a second preferred embodiment of the present invention, schematically.
Figure 14:
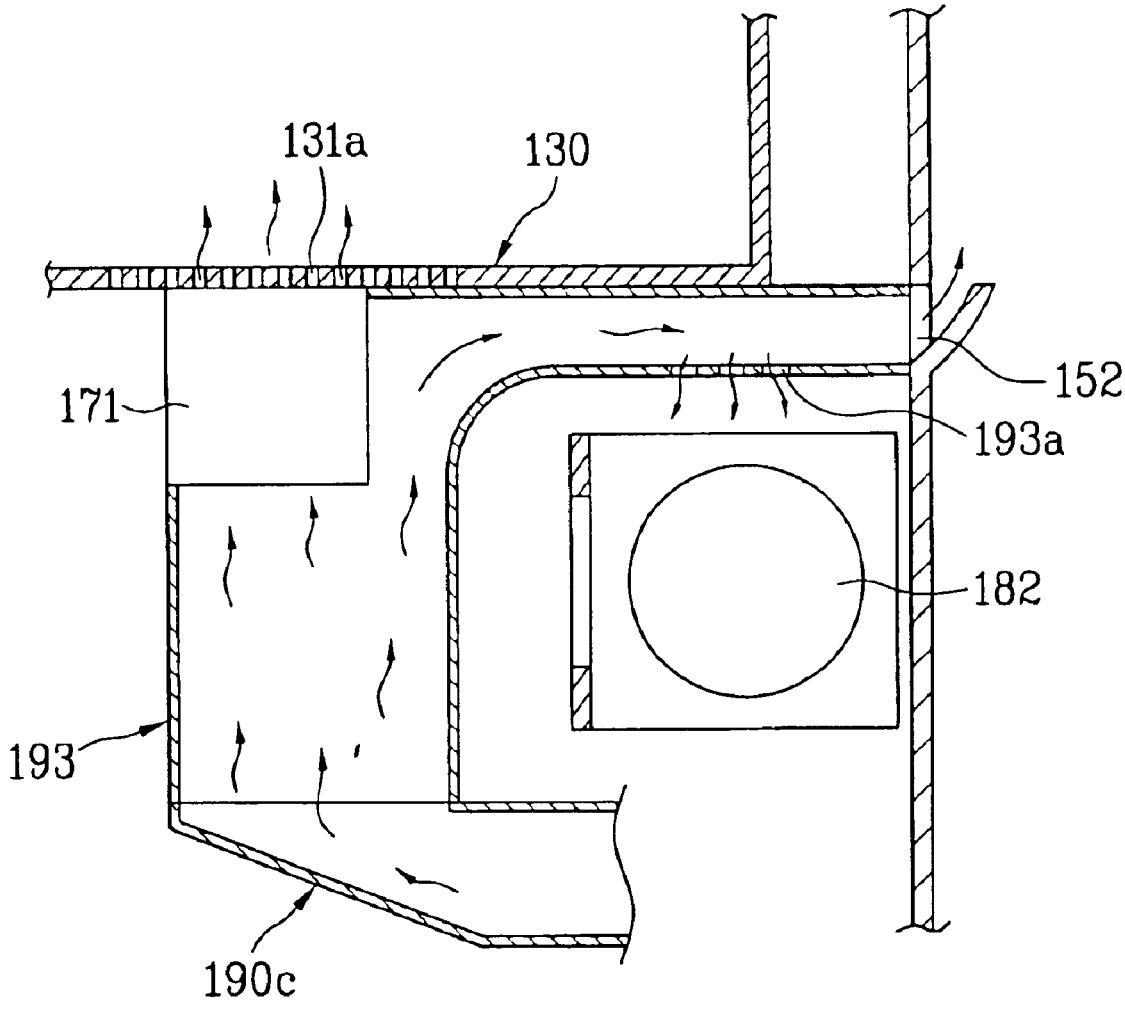
FIG. 14 illustrates a fitted state of a second duct of an air duct in the microwave oven of the present invention, schematically.

In the meantime, as shown in FIGS. 13 and 14, the second embodiment of the present invention suggests a second duct 193 connected to the first branch duct 190*a* for guiding air flow to the rear panel 150. The second duct 193 is connected to the second outflow hole 152 in the rear panel 150 directly, and the first magnetron 171 is installed in the second duct 193.

A fact, that a flow rate of the air introduced into the inner case 130 through the first magnetron 171 is very small in comparison to a flow rate introduced through the air duct 190, is taken into account in a structure of the second duct 193. Therefore, a portion of the air introduced into the second duct 193 is introduced into the inner case 130 through the first magnetron 171, and rest of the air is discharged to outside of the cabinet. In conclusion, the second duct 193 reduces an air flow resistance which may be caused by the air that fails to pass through the first magnetron 171 smoothly to the maximum.

In the meantime, the second duct 193 has a first communication hole 193*a* for cooling the fan motor 182. The first communication hole 193*a* guides a portion of the air flowing through the second duct 193 to the fan motor 182 to cool the fan motor 182.

Accordingly, a portion of the air introduced into the second duct 193 is introduced into the inner case 130 through the inlet holes 131*a*, and rest of the air is discharged to an outside of the cabinet through the second outflow hole 152 via the second duct 193. In this instance, a portion of the air flowing toward the second outflow hole 152 along the second duct 193 is introduced into a space of the fan motor 182 through the first communication hole 193*a*, and cools the fan motor 182.

Description of the air flow introduced into the second branch duct 190*b*, given in detail in the first embodiment, will be omitted.

At the end, the second duct 193 discharges the air introduced into the cabinet by the fan 181 as quick as possible to an outside of the cabinet. Therefore, by increasing a flow rate of the air introduced into the second duct 193, an overall cooling efficiency of the microwave oven can be improved.

Figure 15:
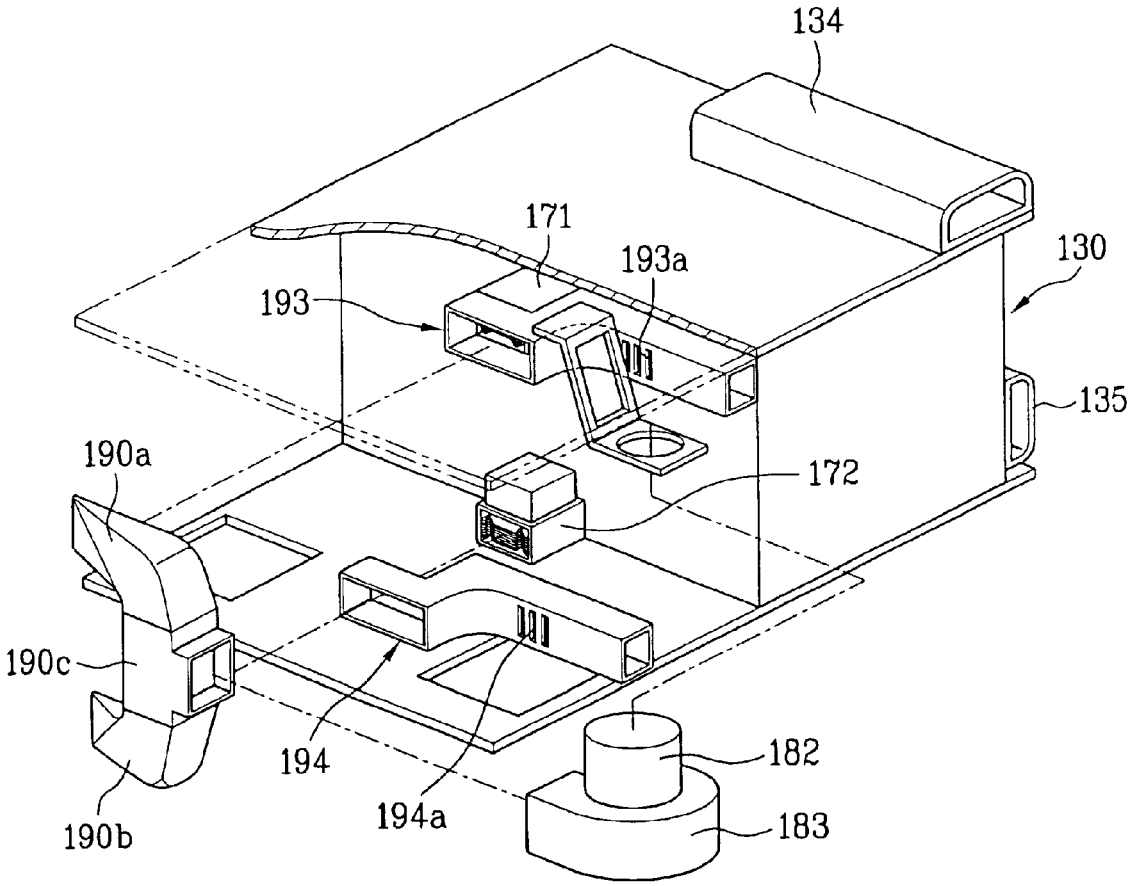
FIG. 15 illustrates a disassembled perspective view showing an inside structure of a microwave oven in accordance with a third preferred embodiment of the present invention, schematically.

In the meantime, as shown in FIG. 15, the third embodiment of the present invention suggests a third duct 194 connected to the second branch duct 190*b* for guiding air flow toward the rear panel 150. The third duct 194 is connected to the third outflow hole 153 in the rear panel 150, and the second magnetron 172 is mounted inside of the third duct 194.

The third duct 194 also has a second communication hole 194*a* for cooling the fan motor 182, too. Therefore, if the third duct 194 and the second duct 193 are fitted together, not only the cooling efficiency of the fan motor 182 can be improved, but also an internal air flow can be made smoother. In this instance, the third duct 194 may, or may not be formed as a unit with the second duct 193.

In the meantime, the structures of the foregoing embodiments may be applied to microwave ovens for stores which have two transformers and two magnetrons, or even to microwave ovens for domestic use having one of the magnetrons and the transformers removed therefrom.

The microwave oven having one of the magnetrons and the transformers removed therefrom can be a domestic microwave oven. Therefore, by adjusting numbers of the magnetrons and the transformers mounted thereon, the microwave ovens of the present invention can be used as microwave ovens for stores or for homes.

As has been described, the microwave oven of the present invention has the following advantages.

First, by adjusting arrangements of the magnetrons and the transformers appropriately, a front to rear length of the microwave oven can be reduced. According to this, a size of the cooking chamber can be enlarged, to provide a more useful structure.

Second, by cooling the transformers uniformly, performances of the transformers can be improved. That is, the structure of the present invention permits smooth cooling of the transformer in a part air flow thereto is poor in the related art by guiding air thereto.

Third, the smooth cooling of the fan motor can minimizes damage to the fan motor caused by overheating of the fan motor.

Fourth, the microwave oven of the present invention permits manufacturing of microwave ovens of different purposes of use with one production line.

That is, because structures of microwave oven for home and microwave oven for stores are different in the related art, different production lines are required for each of purposes of use of the microwave ovens. However, what is required for the microwave oven of the present invention is change of the numbers of magnetron and transformers, manufacturing of the microwave oven with only one production line is possible.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A microwave oven, comprising:

an outer case forming a top and sides of a cabinet;

a base plate forming a bottom of the cabinet;

a front panel and a rear panel mounted in a front part and a rear part of the base plate for forming a front surface and a rear surface, respectively;

an inner case forming a cooking chamber on the base plate;

first and second transformers mounted at corners of one side of the base plate;

a fan positioned above the second transformer for drawing external air into the inner case via the first and second transformers;

a fan motor connected to the fan for providing a driving power to the fan;

a fan housing for protecting the fan;

an air duct positioned at least partially between the first and second transformers so that the air duct is at least partially interposed between the transformers, the air duct having one end in communication with the fan housing and the other end branched to form first and second branch ducts; and first and second magnetrons positioned on an outside surface of the inner case, wherein the first and second magnetrons are connected to the first and second branch ducts, respectively.

2. The microwave oven as claimed in claim 1, wherein the base plate includes a front part having a plurality of inflow holes.

3. The microwave oven as claimed in claim 2, wherein the base plate is provided with a guide for uniform supply of external air introduced thereto through the inflow holes to the first and second transformers.

4. The microwave oven as claimed in claim 3, wherein the guide is in the form of a square bar having one end positioned between the inflow holes and the other end positioned between the first and second transformers.

5. The microwave oven as claimed in claim 1, wherein the inner case comprises:

a plurality of inlet holes for introduction of air passed through the first and second branch ducts and the first and second magnetrons into the inner case; and a plurality of outlet holes for discharging the air introduced into the inner case.

6. The microwave oven as claimed in claim 5, wherein the outlet holes are connected to a plurality of discharging ducts for guiding flow of air discharged from the inner case.

7. The microwave oven as claimed in claim 6, wherein the rear panel has a plurality of first outlet holes connected to the discharging ducts for discharging air to outside of the cabinet.

8. The microwave oven as claimed in claim 1, wherein the rear panel has at least one second outflow hole for discharging the air passed through the second transformer.

9. The microwave oven as claimed in claim 1, wherein the air duct is mounted so as to be spaced a distance apart from an inside wall of the outer case.

10. The microwave oven as claimed in claim 9, wherein the first and second branch ducts of the air duct include sloped duct walls, respectively, such that each branch duct becomes narrower as the respective branch duct gets closet to the respective first or second magnetron.

11. The microwave oven as claimed in claim 10, wherein the first branch duct is connected to a first duct for guiding air flow toward the fan motor, and the first magnetron is connected to the first duct.

12. The microwave oven as claimed in claim 10, wherein the rear panel has a second outflow hole for discharging the air cooled by the fan motor through the first duct to an outside of the cabinet.

13. The microwave oven as claimed in claim 10, wherein the first branch duct is connected to a second duct for guiding the flow of air to the rear panel, and the first magnetron is mounted in the second duct.

14. The microwave oven as claimed in claim 13, wherein the rear panel includes a second outflow hole connected to the second duct for discharging the air introduced thereto to outside of the cabinet.

15. The microwave oven as claimed in claim 14, wherein the second duct includes a first communication hole formed therein for supplying air for cooling the fan motor.

16. The microwave oven as claimed in claim 10, wherein the second branch duct is connected to a third duct for guiding the flow of air to the rear panel, and the second magnetron is in the third duct.

17. The microwave oven as claimed in claim 16, wherein the rear panel includes a third outflow hole for discharging the air introduced thereto to outside of the cabinet.

18. The microwave oven as claimed in claim 17, wherein the third duct includes a second communication hole for guiding air flow to the fan motor.

19. The microwave oven as claimed in claim 1, wherein the air duct includes a split guide between the first and second branch ducts for guiding the air introduced thereinto by the fan.

20. The microwave oven as claimed in claim 19, wherein the split guide is formed by bending an inside wall of the air duct.

21. A microwave oven, comprising:

an outer case forming a top and sides of a cabinet;

a base plate forming a bottom of the cabinet;

an inner case forming a cooking chamber disposed within the outer case;

first and second transformers positioned on the base plate;

a fan apparatus positioned adjacent one of the first and second transformers and configured to draw external air into the inner case via the first and second transformers;

an air duct positioned at least partially between the first and second transformers so that the air duct is at least partially interposed between the transformers, the air duct having one end in communication with the fan apparatus and the other end branched to form first and second branch ducts; and at least one magnetron positioned outside the inner case, wherein the at least one magnetron is connected to the air duct.

22. The microwave oven as claimed in claim 21, further comprising:

a front panel and a rear panel mounted in a front part and a rear part of the base plate for forming a front surface and a rear surface, respectively.

23. The microwave oven as claimed in claim 21, wherein the fan apparatus comprises:

a fan;

a fan motor connected to the fan and configured to provide a driving power to the fan; and a fan housing configured to protect the fan.

24. The microwave oven as claimed in claim 21, wherein the at least one magnetron comprises first and second magnetrons and wherein the first and second magnetrons are connected to the first and second branch ducts, respectively, of the air duct.

25. The microwave oven as claimed in claim 24, wherein the inner case comprises:

a plurality of inlet holes configured to introduce into the inner case air that has passed through the first and second branch ducts and the first and second magnetrons; and a plurality of outlet holes configured to discharge the air from the inner case.

26. The microwave oven as claimed in claim 25, wherein the outlet holes are connected to a plurality of discharging ducts configured to guide the air discharged from the inner case.

27. The microwave oven as claimed in claim 25, wherein a rear panel has a plurality of first outlet holes connected to the discharging ducts and configured to discharge the air to outside of the cabinet.

28. The microwave oven as claimed in claim 21, wherein the base plate includes a plurality of inflow holes and a guide is provided on the base plate which is configured to guide external air introduced through the inflow holes to the first and second transformers.

29. The microwave oven as claimed in claim 28, wherein the guide comprises a square bar having one end positioned between the inflow holes and the other end positioned between the first and second transformers.

30. The microwave oven as claimed in claim 21, wherein the first and second branch ducts of the air duct include sloped duct walls, respectively, such that each branch duct becomes narrower as the respective branch duct gets closer to the respective first or second magnetron.

31. The microwave oven as claimed in claim 21, wherein the air duct includes a split guide between the first and second branch ducts configured to guide air introduced thereinto by the fan.

* * * * *